United States Patent [19]

Swengel, Jr. et al.

[11] 4,298,243

[45] Nov. 3, 1981

[54] PRE-INSULATED FLAG-TYPE TERMINAL

[75] Inventors: Robert C. Swengel, Jr., York County; Jon A. Fortuna; George R. Defibaugh, both of Cumberland County, all of Pa.

[73] Assignee: AMP Incorporated, Harrisburg, Pa.

[21] Appl. No.: 914,310

[22] Filed: Jun. 12, 1978

[51] Int. Cl.[3] ..... H01R 11/08

[52] U.S. Cl. ..... 339/276 F

[58] Field of Search ..... 339/276 F, 276 SF, 276 T

[56] References Cited

U.S. PATENT DOCUMENTS

| | | | |
|---|---|---|---|
| 1,946,713 | 2/1934 | Rowley | 339/276 T |
| 2,740,101 | 3/1956 | Betts . | |
| 2,869,096 | 1/1959 | Miller | 339/276 F |
| 2,945,206 | 7/1960 | Hammell | 339/276 F |
| 3,320,357 | 5/1967 | Houbolt . | |
| 3,512,123 | 5/1970 | Costello et al. | 339/276 T |
| 3,577,119 | 5/1971 | Delyon | 339/276 T |

*Primary Examiner*—Joseph H. McGlynn

*Attorney, Agent, or Firm*—Frederick W. Raring

[57] ABSTRACT

Pre-insulated flag-type terminal device comprises a flag-type contact terminal and a housing which completely encloses the terminal. The terminal has a tubular crimp portion and a contact portion which extends laterally from the crimp portion. The width of the contact portion is the same as that of the crimp portion. The housing comprises a molded part having a terminal-receiving section and a laterally extending wire-receiving housing arm. An opening extends through the arm and communicates with the terminal-receiving cavity in the terminal-receiving portion. The crimp portion has a wire-receiving end which is immediately adjacent to the inner end of the wire-receiving opening.

3 Claims, 8 Drawing Figures

PRE-INSULATED FLAG-TYPE TERMINAL

DESCRIPTION

Background of the Invention

This invention relates to flag-type pre-insulated terminal devices for the type which are intended for crimping onto the end of an insulated wire to produce a fully insulated termination of the wire end.

Pre-insulated terminals of the type comprising a tubular crimp barrel, a contact portion extending axially from the crimp barrel, and a cylindrical insulating sheath surrounding the crimp barrel are widely used in the electrical industry. Devices of this type can be crimped directly onto the end of a wire so that the finished termination is provided with an insulating covering over the crimped electrical connection and, if desired, in surrounding relationship to the contact portion which extends from and is aligned with the crimped connection.

A flag-type terminal has a crimp portion and a contact portion which extends laterally, rather than axially, from the crimp portion and devices of this type are also widely used in many branches of the electrical industry; see for example U.S. Pat. Nos. 2,945,206; 3,123,431; 3,699,505; and 3,771,111. These prior art patents show uninsulated flag-type terminal devices which are adapted to be crimped directly onto wires. If an insulated termination is required under particular circumstances, it has usually been necessary in the past to assemble an insulating housing to the terminal after it has been crimped onto a wire end. U.S. Pat. No. 3,641,641 shows one type of housing which can be assembled to a flag-type terminal after crimping. For several reasons, this requirement that the housing be assembled to the terminal after crimping is regarded as an expensive and time-consuming inconvenience in the industry. However, the difficulties and problems associated with the manufacture and crimping of pre-insulated flag-type terminations have limited the use of such devices in the past and the available pre-insulated flag-type terminals have shortcomings which adversely affect their electrical integrity and their mechanical reliability.

The problems which are encountered when one attempts to provide an insulating housing on a flag-type terminal stem in part from the fact that the crimpable portion, that is the tubular ferrule, of the terminal cannot be provided with an encircling tubular insulating sheath as can be done with a terminal of the type having a contact portion which extends axially from the ferrule. The ferrule of a flag-type pre-insulated terminal is located at the closed inner end of a cavity in the insulating housing with the walls of the housing extending substantially tangentially and laterally from the ferrule. This requirement renders conventional crimping techniques inapplicable and the technology which has been developed in the crimping of conventional pre-insulated terminals is not directly usable in the crimping of pre-insulated flag-type terminal devices. An additional problem in the design of pre-insulated flag-type terminal devices arises from the fact that it has not been possible in the past to provide adequate ferrule length relative to the required width of the contact portion of the terminal; finally, it is inconvenient and impractical to design a pre-insulated flag-type termination using known techniques which is capable of accepting a reasonably wide range of wire gages. These considerations of ferrule length in flag-type terminations and acceptable wire ranges are discussed more fully below.

In accordance with the principles of the instant invention, a flag-type termination comprises a terminal having a tubular ferrule which is formed by reverse curling through substantially 360 degrees of an arm which extends from the contact portion of the terminal. The arm is so constructed that a ferrule is produced on the terminal which has a length which is substantially equal to the width of the contact portion of the terminal. As a result, a relatively secure and electrically sound crimped connection can be obtained when the terminal is crimped onto a wire. Since the ferrule has a length equal to the width of the terminal, it is also possible to provide an insulating housing having a wire-receiving opening thereon which leads directly to the wire-receiving end of the ferrule. This feature greatly facilitates the insertion of a wire through the opening in that it ensures accurate guidance of the wire into the ferrule portion of the terminal. The terminal and the insulating housing are constructed such that an electrically sound and mechanically secure crimped connection can be obtained by crimping the housing and the ferrule onto the wire end.

A preferred embodiment of the invention is described in detail below and illustrated in the accompanying drawing in which.

Figure 4:
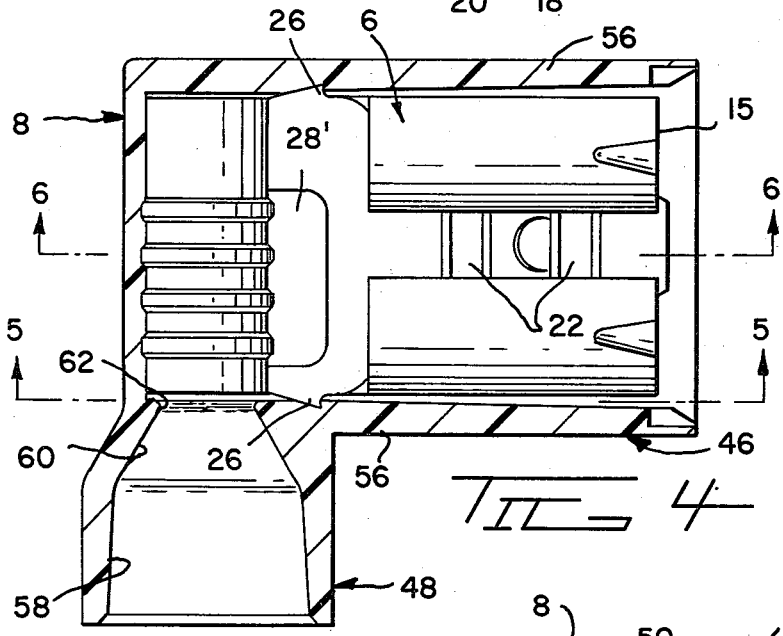
FIG. 4 is a sectional plan view of a pre-insulated flag-type terminal in accordance with the invention.
Figure 5:
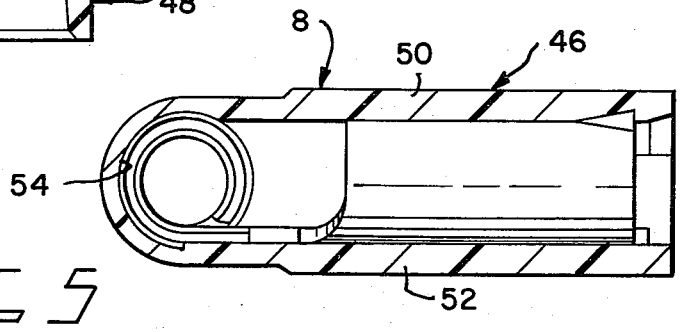
Figure 6:
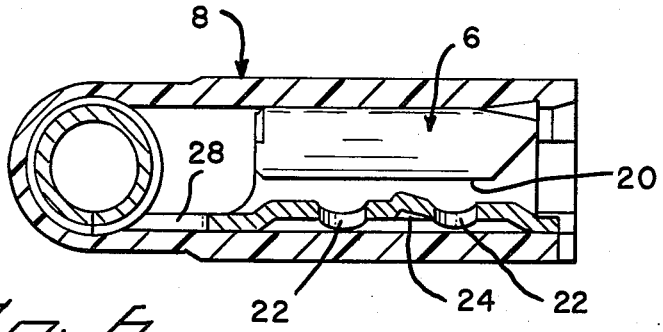

FIGS. 5 and 6 are views taken along the lines 5—5 and 6—6 respectively of FIG. 4.

Figure 7:
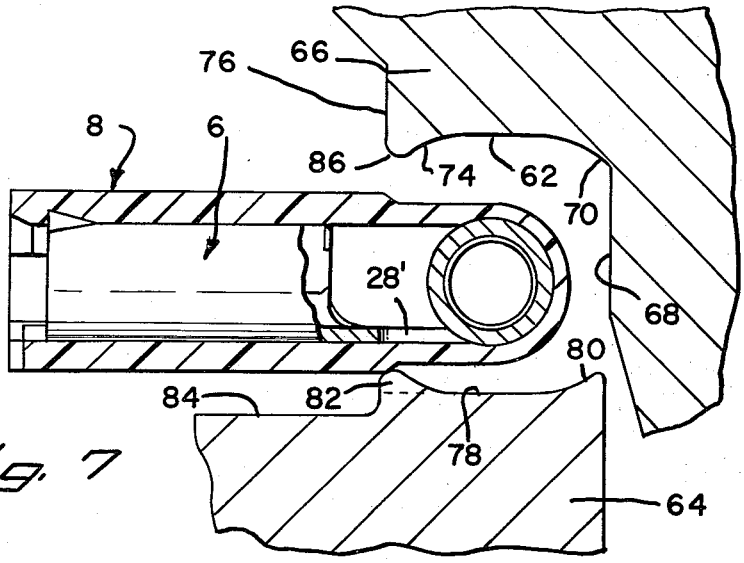

FIG. 7 is a frontal view of a crimping die and crimping anvil for crimping the terminal device onto a wire, this view showing the die and anvil in their separated or open positions and showing an uncrimped terminal positioned on the surface of the anvil.

Figure 8:
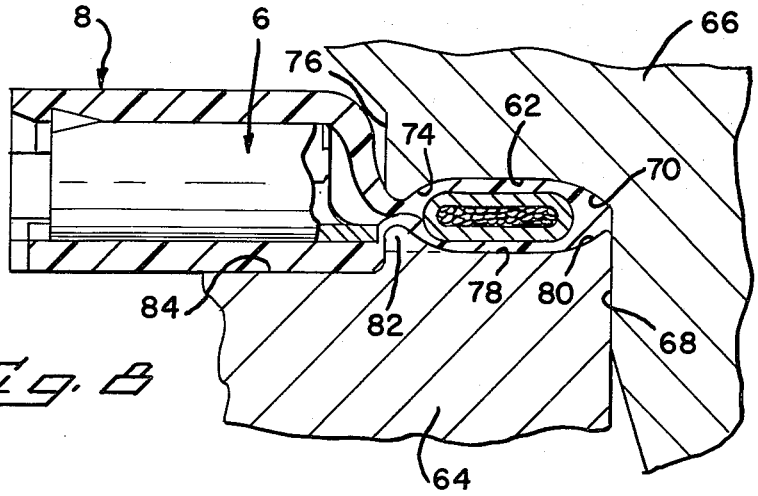

FIG. 8 is a view similar to FIG. 7 but showing the die and anvil in their closed positions and showing the cross-sectional view of the ferrule after crimping.

Figure 1:
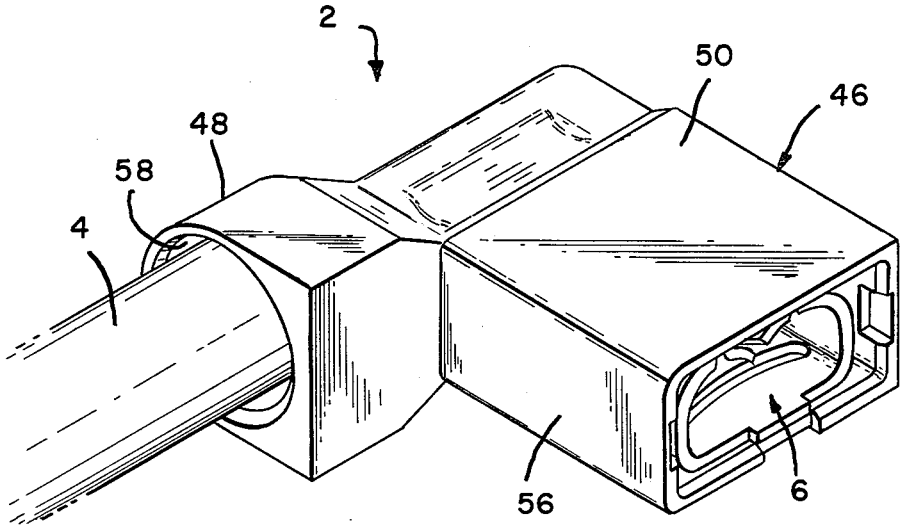
FIG. 1 is a perspective view of a pre-insulated flag-type terminal in accordance with the invention crimped onto a wire.
Figure 2:
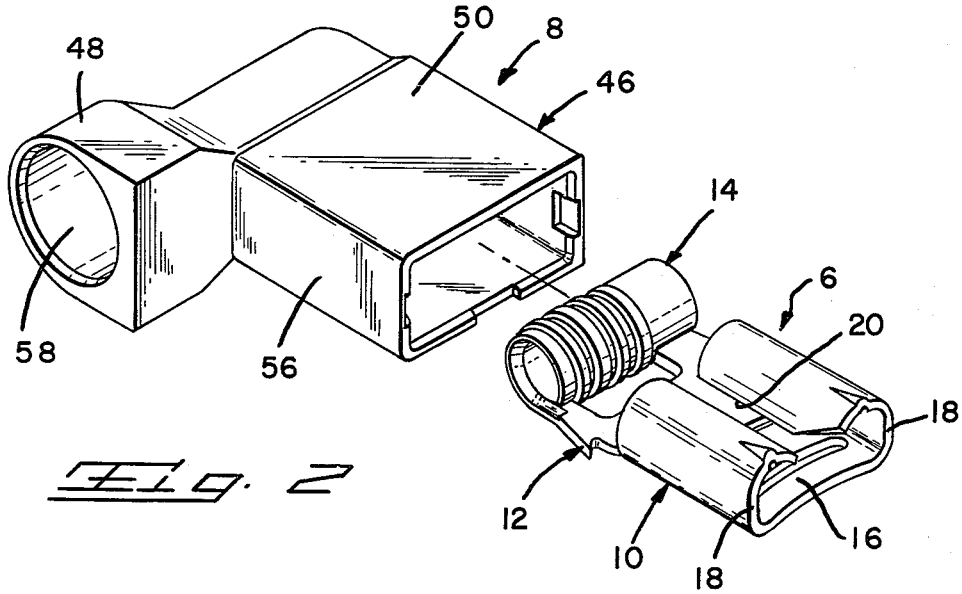
FIG. 2 is a perspective view of a housing having the terminal device exploded therefrom.
Figure 3:
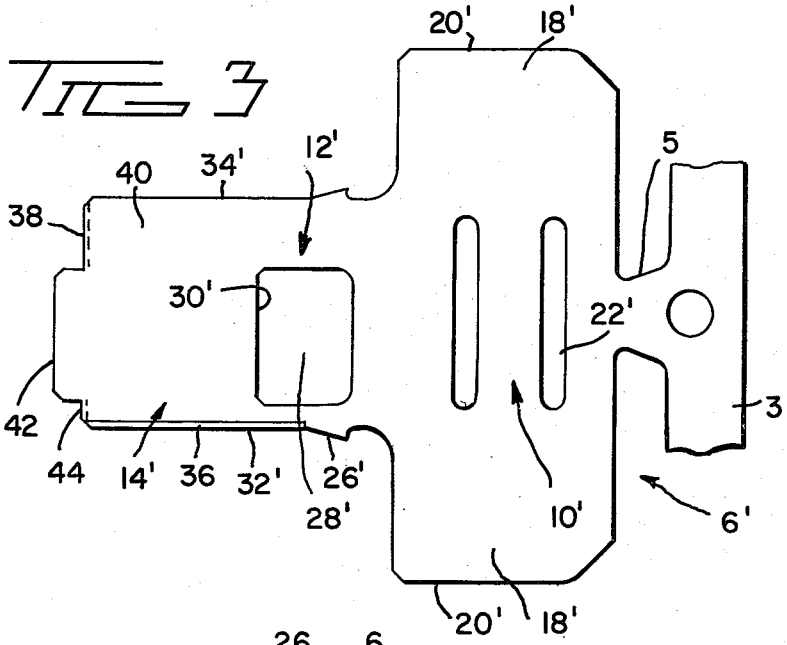
FIG. 3 is a plan view of the sheet metal blank from which a terminal in accordance with the invention is formed.

Referring first to FIGS. 1–3, the flag-type terminal device 2 which is intended for crimping onto a wire 4 in accordance with the invention comprises a stamped and formed metallic terminal 6 which is contained in an insulating housing 8 of a suitable thermoplastic material such as a nylon composition. The terminal 6 is described below with reference to FIGS. 3–6, FIG. 3 showing the sheet metal blank from which the finished terminal is formed. The same reference numerals, differentiated by prime marks, are used to denote the structural features of the formed terminal and the corresponding portions of the flat blank of FIG. 3.

The terminal comprises a contact receptacle portion 10, a flat transition portion 12, and a crimp portion 14 in the form of a tubular ferrule which is at the opposite end of the terminal from the end of the contact portion. The contact portion comprises a web 16 having sidewalls 18 extending from its marginal side portions. These sidewalls are curled inwardly towards each other and towards the surface of the web so that the edges 20 of the sidewalls are spaced from the surface of the web. Slots 22 extend transversely across the web and the section of the web material between these slots is upwardly formed as shown at 24 to provide a contact spring. Contact receptacles of this type are commonly used and are dimensioned to receive a flat tab-type terminal which is inserted into the outer end 15 and moved into the gap between the web and the edges 20.

The centrally located flat transition section 12 and the tubular ferrule are formed from an arm 40, FIG. 3, having side edges 32', 34'. A rectangular opening 28' is provided in this arm which extends, as shown in FIG. 6, up to the ferrule portion of the terminal. This opening has a transversely extending edge 30 and the opening receives a projecting ear 42 extending from the end of the arm 40 so that the ferrule has a seam, as shown in FIG. 6, at the end of the opening 28. The portions 44, 38 on the end of the arm 40 are disposed against the surface of the transition section 12 on each side of the opening 28 so that the ferrule extends the full width of the terminal as is apparent from FIG. 4. Advantageously, the end portions 44, 38 of the arm are beveled so that these edges are disposed immediately adjacent to the surface of the transition section and the side edge 32 is beveled as shown in 36. This bevel 36 provides a conical surface at the wire-receiving end of the ferrule which assists in guiding an inserted wire into the ferrule portion.

Terminals in accordance with the invention are produced by stamping and forming of a continuous strip so that each terminal is integral with a continuous carrier strip 3 and connected thereto by means of a connecting section 5, as shown in FIG. 3. The side edges of the transition section are provided with outwardly extending barbs 26 which serve to retain a housing on the terminal.

The insulating housing 8 comprises a generally rectangular terminal-receiving section 46 having an arm 48 extending laterally therefrom. A terminal-receiving cavity extends into the housing and a wire-receiving opening extends into the arm, this opening and this cavity communicating with each other at a constricted wire entry port 62, shown in FIG. 4. The terminal-receiving section 46 has top and bottom walls 50, 52 and parallel sidewalls 56 which define the terminal-receiving cavity. The inner end of the cavity has a cylindrical surface 54 as shown which conforms to the curvature of the ferrule portion 14 of the terminal so that the housing can be assembled to the terminal by merely moving the terminal through the opening end of the housing until it is seated against the inner end 54 of the cavity. The terminal is retained in position in the housing by the previously identified barbs 26 which dig into the internal surface of the sidewalls 56.

The wire-receiving opening in the arm 38 has an enlarged entrance section 58 which is dimensioned to receive the insulation of the wire 4. This entrance section merges with a convergent conical surface 60 which extends to the previously identified entry port 62. Advantageously, the diameter of this entry port is slightly less than the inside diameter of the ferrule portion 4 of the terminal so that an inserted wire will be guided into the interior of the ferrule and will not move against any transversely extending surfaces. The close proximity of the wire-receiving end of the ferrule and the port 62 is a particularly desirable feature in contributing to guidance of the wire into the ferrule.

The uncrimped connecting device, as shown in FIG. 4, is applied to the stripped end of a wire by placing the connecting device on the surface 78 of a crimping anvil 64 and thereafter moving a crimping die 66 towards the anvil from the position of FIG. 7 to the position of FIG. 8. The die 66 has a vertically extending side surface 68 which merges with a crimping surface having a horizontally extending central section 62 and downwardly sloping surface portion 70, 74 on each side thereof as viewed in FIG. 7. The left hand side 76 of the die 66 extends vertically from the crimping zone to provide clearance for the housing. The upper surface 78 of the anvil slopes upwardly, as viewed in FIG. 7 and as shown at 80, towards the surface 68 and a centrally located upwardly sloped projection 82 is provided which is in alignment with the opening 28 when the terminal is properly positioned on the anvil. Projection 82 cooperates with the lower-most portion 86 of the die to pinch the housing and thereby crimp the ferrule in the zone adjacent to the opening 28 of the terminal. The surface 84 of the anvil is relieved to the left of the crimping zone to provide clearance for the housing.

It will be apparent from FIG. 8 that upon crimping, the ferrule is flattened and its cross-sectional area is substantially reduced so that the wire will be tightly confined in the ferrule. Portions of the ferrule are inwardly deformed during crimping as shown in FIG. 8. This inward deformation contributes to the reduction of the cross-sectional area of the ferrule and the attainment of a good crimped connection.

The terminals can be produced of any suitable material having spring properties which are adequate for the contact portion there, in other words, material which will produce the required spring characteristics in the curved sidewalls 18 and in the upwardly formed spring section 24 of the web. Under some circumstances, and particularly if a relatively hard material is used in the manufacture of the terminals, it may be desirable to selectively anneal the ferrule portion of the terminal thereby to improve its crimping characteristics.

Flag-type pre-insulated terminals, in accordance with the invention, offer several salient advantages which permit the achievement as a practical matter of this type of termination and which produce an electrically stable and mechanically secure termination on a wire. As noted above, the ferrule portion of the terminal extends for the full width of the terminal rather than for only a portion of the width. By virtue of the fact that the ferrule is relatively long, an extremely strong crimp barrel is provided and those portions of the barrel on each side of the opening 28 contribute significantly to the strength and electrical stability of the crimped connection. Furthermore, and as noted above, the fact that the wire-receiving end of the ferrule is immediately adjacent to the wire entry port 62 ensures that the wire will be guided accurately into the ferrule when it is inserted into the opening in the arm 48.

It will be apparent from FIG. 3 that the material in the ferrule is obtained from the end portion of the arm 40, that is, the portion of this arm which lies between the edge 30, 30' in the blank and the leading edges 38, 44 of the arm. By virtue of this fact, the diameter of the ferrule can be increased or decreased without significant change of the distance between the axis of the barrel or ferrule and the outer end 15 of the contact portion of the terminal. This feature is very important for the reason that it is always necessary to provide a terminal in two or more sizes as regards wire range; in other words, it is necessary to provide different barrel sizes for the same terminal in order that different wire sizes can be accommodated. It is extremely important, however, that the overall dimensions of the terminal remain constant notwithstanding the fact that two or more barrel diameters are provided. This feature is thus achieved in conjunction with the relatively long barrel noted above.

We claim:

1. A pre-insulated flag-type terminal device which is intended to be crimped onto the stripped end of an insulated wire, said terminal device comprising a metallic contact terminal and an insulating housing means, said terminal comprising a contact portion, a crimp portion, and a flat transition section, said transition section being between said contact portion and said crimp portion and having side edges which extend from said contact portion to said crimp portion, an opening between said side edges, said opening having one edge which is proximate to said crimp portion and which extends transversely of said side edges, said crimp portion comprising an arm extending from said transition section in the direction opposite to the direction of said contact portion, said arm being reversely formed towards said contact portion and towards said transition section, said arm having an end which extends transversely across said transition section, said end having an ear extending centrally therefrom into said opening, said ear having a leading edge which extends beside said one edge of said opening, an adjacent portion of said end of said arm which is on one side of said ear being adjacent to said transition section whereby said arm forms a tubular ferrule having a wire-receiving end which is at one of said side edges, said housing means being generally flag-shaped and having a terminal housing portion and wire-receiving housing arm extending therefrom, a terminal receiving cavity in said housing portion and a wire-receiving opening extending through said housing arm and communicating with said cavity, said terminal being in said cavity with said ferrule in alignment with said opening, said wire-receiving opening having a conical inner end portion adjacent to said cavity, a constricted wire-admitting port at the inner end of said conical inner end portion, said port being immediately adjacent to, and concentric with, said wire-receiving end of said ferrule whereby, upon insertion of the stripped end portion of an insulated wire into said opening, the leading end of said wire will be guided by said conical surface through said port and will immediately enter said ferrule, and upon subsequent crimping, said ferrule will be crimped onto said stripped end of said wire.

2. A pre-insulated flag-type terminal device as set forth in claim 1, said contact portion comprising a contact receptacle.

3. A pre-insulated flag-type terminal as set forth in claim 2, said receptacle comprising a base and sidewalls, said base being co-planar with said transition section, said sidewalls being reversely curled inwardly towards each other and having edges which are spaced from said base, said contact receptacle being dimensioned to receive a contact tab between said edges and said base.

* * * * *